United States Patent [19]

Rutter

[11] Patent Number: 4,475,670

[45] Date of Patent: Oct. 9, 1984

[54] FLUID DISPENSER

[76] Inventor: Christopher C. Rutter, 25200 Carlos Bee Blvd., Hayward, Calif. 94542

[21] Appl. No.: 396,621

[22] Filed: Jul. 9, 1982

[51] Int. Cl.[3] ..... B67B 7/24

[52] U.S. Cl. ..... 222/83; 222/91; 222/105; 222/519

[58] Field of Search ..... 222/80, 81, 83, 89, 222/90, 91, 92, 105, 107, 326, 327, 519, 537, 541

[56] References Cited

U.S. PATENT DOCUMENTS

| | | | |
|---|---|---|---|
| 552,408 | 12/1895 | Barnes | 222/90 |
| 2,009,645 | 7/1935 | Barnes | 222/153 |
| 3,460,715 | 8/1969 | Lane et al. | 222/90 |
| 3,613,955 | 10/1971 | Wetherell, Jr. | 222/83 |
| 4,314,654 | 2/1982 | Gaubert | 222/83 |
| 4,322,018 | 3/1982 | Rutter | 222/83 |
| 4,325,496 | 4/1982 | Malpas | 222/83 |

FOREIGN PATENT DOCUMENTS 31184 of 1884 Fed. Rep. of Germany ..... 222/519

*Primary Examiner*—Joseph J. Rolla
*Assistant Examiner*—Michael S. Huppert
*Attorney, Agent, or Firm*—Linval B. Castle

[57] ABSTRACT

Dispensers for flexible sealed plastic bags used for the storage of wines or other liquids that may spoil when exposed to the air. The outer sleeve of each of the described embodiments of the dispenser is attached to the exterior surface of the sealed bag and either cuts or shears open the bag by a combination of rotational and longitudinal movement of the barrel of the dispenser within the sleeve. The fluid is thereafter dispensed through radial holes through the sleeve and the barrel by only rotational adjustment of the sleeve within the barrel.

8 Claims, 12 Drawing Figures

FLUID DISPENSER

CROSS-REFERENCE TO RELATED APPLICATIONS

The invention described and claimed herein is related to inventions disclosed in copending patent application Ser. No. 317,060, filed Nov. 2, 1981 now U.S. Pat. No. 4,421,297 for "Self-Closing Rotatable Fluid Dispensing Valves", and in copending application Ser. No. 225,788, filed Jan. 16, 1981 now U.S. Pat. No. 4,355,737, for an angle mounted fluid dispensing valve that pierces an opening in its attached flexible fluid container when first rotated to its open position.

BRIEF SUMMARY OF THE INVENTION

This invention relates to bulk fluid containers and particularly to novel fluid dispensers for small bulk fluid containers such as those having a relatively rigid outer box of corrugated paper board and a flexible, sealed, fluid-containing inner bag.

Boxed bulk containers of this type are especially valuable for the shipping, storage and dispensing of fluids that may become contaminated or otherwise deteriorated when exposed to an oxidizing atmosphere. In general, such containers employ a dispenser having a flange cemented to a bag of a flexible plastic material that will not deleteriously affect the fluid. The bag is filled, sealed, and placed in an outer container supporting box of corrugated cardboard or the like.

If properly filled and sealed, the bag will contain no air or other gasses that may damage the fluid during storage. When ready for use, a dispenser having a sharp point or cutting edge is inserted through the center of the flange to pierce the plastic bag and provide a valved dispenser for the fluid as described in my U.S. Pat. No. 4,322,018, U.S. Pat. No. 3,239,104 to Scholle, or U.S. Pat. No. 3,642,172 to Malpas. As the fluid is dispensed from the container, the flexible plastic bag correspondingly shrinks in volume without admitting air. Therefore, if the container is used for the storage and dispensing of oxygen-sensitive fluids, such as wine, a partially filled container may be stored for long periods of time without danger of oxidation and souring of the contents.

Most prior art dispensers employ a longitudinally movable dispenser barrel having a sharpened point centered between end openings in the inner end of the barrel for admitting the fluid from the pierced fluid bag into the dispenser. When the barrel is rotated so that a radial hole near its outer end becomes aligned with a corresponding radial hole in the barrel supporting sleeve, the fluid is dispensed.

Because fluid bags are usually non-refillable, they are discarded when empty along with the attached dispenser assemblies. The dispensers are therefore molded of a relatively inexpensive plastic material with piercing points that are often so dull that it is quite difficult to pierce the plastic bag diaphragm across the end of the attached dispenser sleeve. When such piercing difficulties occur, then the dull point may become bent or even broken to further complicate the bag-piercing operation.

My copending patent application Ser. No. 225,788, filed Jan. 16, 1981, describes and claims a dispenser in which the dispenser sleeve is attached to the bag at an oblique angle and the barrel within the sleeve has a sharpened tongue which slices an opening in the diaphragm when the barrel is first rotated to its "on" or dispensing position. In that dispenser there is only rotation between barrel and sleeve and no longitudinal movement of the barrel takes place.

Briefly described, the present invention includes several embodiments of dispensers which either cut or shear open the plastic bag diaphragm by a combination of both rotational and longitudinal movement of the barrel within a sleeve that is perpendicularly attached to the fluid bag surface. Three embodiments of the invention employ a barrel having a plurality of sharpened longitudinal cutting teeth on the inner end of the barrel which, when first rotated, is advanced into the outer sleeve by threaded members in either the barrel or outer sleeve. In two other embodiments, the inner end of the barrel is cemented to the fluid bag and is sheared open by a combination of rotation and inward longitudinal movement of the barrel. One important advantage in these shearing embodiments is that there is no residual bag material that can accidentally block the entrance holes or bore of the dispensing barrel. After opening the fluid bags, all embodiments dispense the fluid by rotation of the barrel to a point of alignment of corresponding radial dispensing holes in both the barrel and the sleeve.

DESCRIPTION OF THE DRAWINGS

In the drawings which illustrate several embodiments of the invention.

DETAILED DESCRIPTION OF THE PREFERRED EMBODIMENTS

Figure 1:
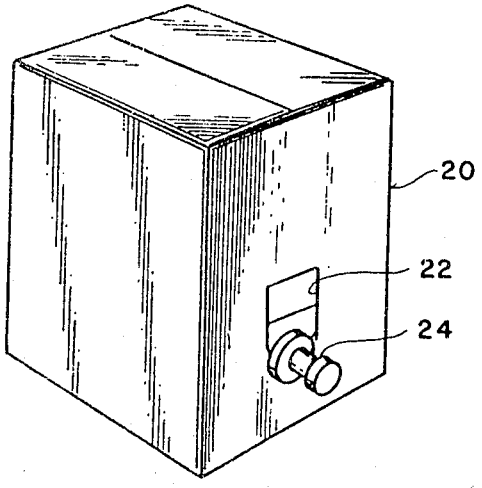
FIG. 1 is a perspective view of a fluid container box illustrating the fluid dispenser.
Figure 2:
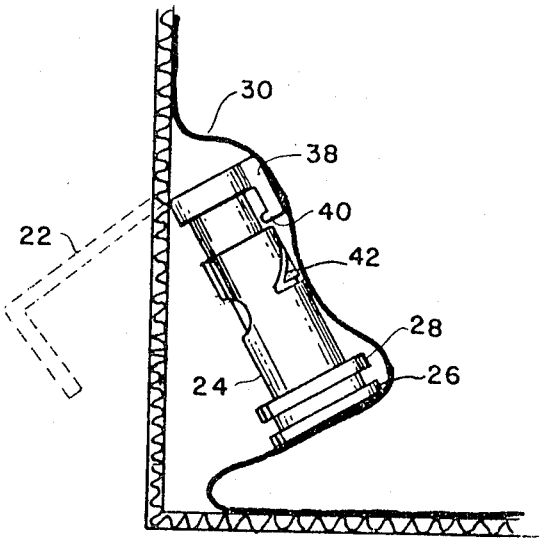
FIG. 2 is a cross-sectional elevation view illustrating the dispenser of FIG. 1 within the container.

Illustrated in the perspective view of FIG. 1 is a fluid container box 20 of corrugated paper board or similar materials having a suitable bursting strength to support the sealed inner container of a suitable plastic material containing a liquid. Near the lower end of the front surface of the box 20 is a rectangular shaped flap 22 scored through the wall of the container so that it may be lifted to expose a fluid dispenser 24, stored prior to its use behind the flap 22 as illustrated in FIG. 2. When ready for use, the dispenser 24 is withdrawn and a slot formed between spaced annular rings 26 and 28 on the dispenser sleeve engages a corresponding slit formed by the removal of the flap 22.

Figure 4:
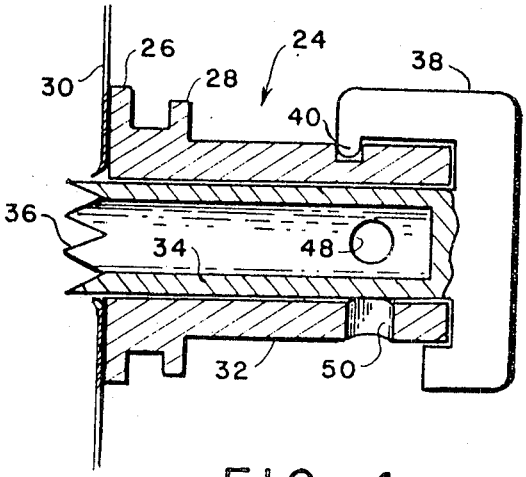
FIG. 4 is a sectional elevation view of the dispenser of FIGS. 2 and 3 illustrating details of the barrel and its connection with the guide track.

As illustrated in FIG. 2 and in greater detail in FIG. 4, the flange formed by the innermost ring 26 is cemented or otherwise firmly attached to the surface of a plastic fluid container bag 30 which is usually fabricated from several plies of various plastic material to obtain a puncture resistant, strong bag that is impervious to air and moisture. As illustrated in FIG. 2, the plastic surface of the bag 30 is stretched over the inner end of the dispenser to form a sealed diaphragm which is punctured by the dispenser only when the contents of the bag are to be withdrawn.

FIG. 4 is a sectional elevation view of one embodiment of the dispenser 24 and illustrates a tubular sleeve 32 containing a coaxial tubular barrel 34. One end of the barrel 34 designated the inner end is provided with a plurality of sharpened longitudinal teeth 36. The opposite or outer end of barrel 34 is provided with a handle 38 which has a tooth 40 that engages a slot 42 cut in the outer surface of the sleeve 32.

Figure 3:
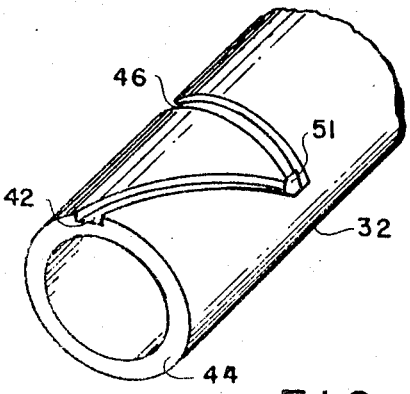
FIG. 3 is a perspective view illustrating a section of the outer sleeve with details of the guide track in the surface.

FIG. 3 is a perspective view illustrating a portion of the sleeve 32 and the details of the slot 42. The slot 42 may have any suitable cross-section, such as rectangular or semicircular, and is cut from the end surface 44 adjacent handle 38 and extends in a spiral around the surface of the sleeve 32 to a point where it reverses direction and forms an annular slot 46. The length of the spiral, or the longitudinal spacing between the end surface 44 and the annular slot 46 should generally correspond to the length of the overreach between handle 38 and its tooth 40. Thus, as best illustrated in FIG. 4, if the tooth 40 is not engaging any portion of the slots 42 or 46, the barrel 34 is partially removed from the sleeve 32 and the sharpened teeth 36 are similarly well removed and cannot puncture the surface of the plastic bag 30. Dispenser 24 illustrated in FIG. 2 is shown with tooth 40 and removed from slot 42, and in this position the entire fluid-dispensing assembly may be shipped or stored without danger of puncturing the fluid bag 30 and the consequent release of the contents.

When the fluid contents of bag 30 are to be dispensed, the dispenser 24 is removed from behind the flap 22 and attached into the slot in the outer container 20. Handle 38 is then rotated to the point where the tooth 40 will engage slot 42. Further rotation of the handle 38 will force the barrel 34 further into the sleeve 32 to the point where the sharpened teeth 36 will puncture or open the plastic bag 30 to permit the fluid therein to enter the bore of the barrel 34. When the tooth 40 engages the annular slot 46, further rotation will align an annular hole 48 in the wall of the barrel 34 near handle 36 with the corresponding radial hole 50 through the wall of the sleeve 32 to thereby provide a valve for dispensing the fluid. It will be noted that the floor of the annular slot 46 is provided with a small step 51 which will prevent the tooth 40 from re-entering the spiral slot 42 in the sleeve 32. Thus, the barrel 34 cannot accidentally be removed from the dispenser.

Figure 5:
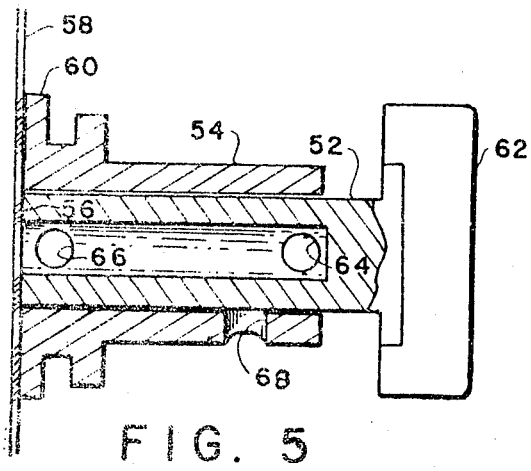
FIG. 5 is a sectional elevation view of another embodiment of the dispenser with sleeve end cemented to the plastic bag diaphragm.
Figure 6:
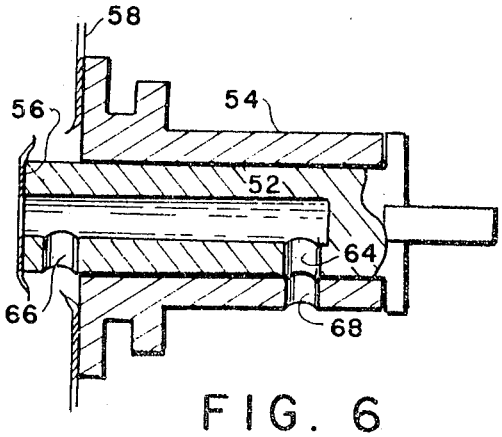
FIG. 6 is a sectional elevation view of the embodiment illustrated in FIG. 5 after the shearing of the plastic bag diaphragm.

FIGS. 5 and 6 are sectional elevation views of another embodiment of a fluid dispenser which shears open the plastic bag by the combination of rotation and longitudinal movement of the barrel 52 within the tubular sleeve 54. In this embodiment, the flat inner end surface 56 of the barrel 52 is cemented to the surface of the fluid bag 58. As indicated by the cross-hatched section of the bag 58, the inner flange 60 of the sleeve 54 is also cemented to the surface of the bag 58.

As with the embodiment illustrated in FIG. 4, the embodiment of FIG. 5 includes a tubular barrel 52 with a suitable handle 62 at its outer end and with a radial dispensing hole 64 in the barrel wall of the barrel and adjacent the handle end thereof. One or more additional radial holes 66 are formed in the wall of the barrel 52 adjacent its end surface 56. A radial dispensing hole 68 is located in the bottom surface of the sleeve 54 near its outer end.

At all times prior to the initial dispensing of the fluid within the bag 58, the barrel 52 extends from the outer end of sleeve 54 so that the end surface 56 is substantially flush with the inner surface of the flange 60. In order to prevent accidental opening of the bag 58 during shipping or storage, a removable plastic band or tear strip having a width corresponding to the extension of the barrel 52 from the outer end of sleeve 54, may be wrapped around the barrel 52 between sleeve 54 and handle 62 for removal by the consumer just prior to dispensing of the fluid. When this tear strip (not shown) is removed, the barrel 52 is rotated by handle 62 and simultaneously urged into the sleeve so that the portion of the plastic bag between the cemented end surface 56 and cemented flange 60 will shear open to permit the fluid contents of the bag to enter the radial hole 66 and the bore of the barrel 52. Although not illustrated in the drawing, the barrel in this embodiment may be rotated and longitudinally moved by a threaded groove and tooth such as shown and explained in connection with FIGS. 2–4 and with other embodiments to be subsequently described. When barrel 52 is rotated to the point where the radial hole 64 is aligned with the hole 68 in the sleeve 54, the fluid will be dispensed. A slight turn in either direction of the barrel 52 will cut off the dispensing of the fluid.

It will be noted that one advantage of the embodiment shown in FIGS. 5 and 6 is that the shearing out of a section of the surface of bag 58 will leave substantially no shredded plastic bag material that can enter or block the passage of fluid through the barrel 52. It will also be noted that the barrel 52 may be removed from the sleeve 54 if it is desired to insert another type of dispenser, such as a suitable plastic extension hose or the like. In such cases, the hose will be inserted completely through the bore of sleeve 54 and into the interior of the bag 58 and the dispensing hole 68 in the sleeve 54 may then be utilized for inserting a hose retainer.

Figure 8:
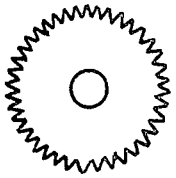
FIG. 8 is an end view of the barrel of FIG. 7 and taken along the lines 8—8 thereof.
Figure 7:
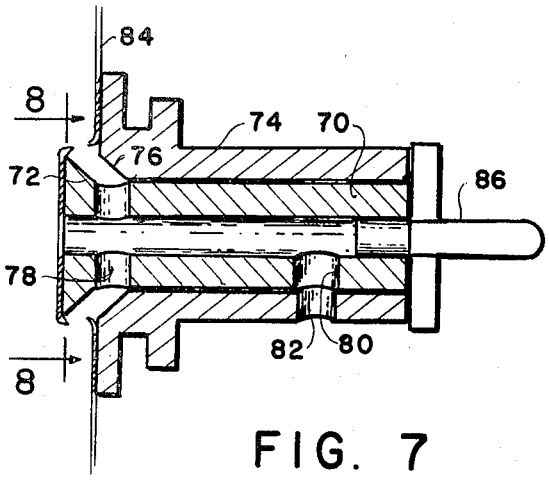
FIG. 7 is a sectional elevation view of a third embodiment of the fluid dispenser.

FIG. 7 is a sectional elevation view illustrating a modification of the embodiment illustrated in FIGS. 5 and 6. In the embodiment of FIG. 7, the barrel 70 is a tubular section having a conical inner end 72 having a sawtooth peripheral edge as shown in FIG. 8. The inner end of the sleeve 74 has a conical surface 76 adapted to mate with the conical end 72 of the barrel 70. One or more radial holes 78 in the sleeve wall adjacent the conical end 72 interconnect the exterior surface of the barrel 70 with its bore and a second radial hole 80 will dispense fluid through the bore of the barrel when aligned with the radial hole 82 through the wall of the sleeve 74. The dispenser of FIG. 7 is assembled by first inserting the barrel 70 into the sleeve 74 and then cementing the conical end surfaces of the barrel and sleeve flange to the outer surface of the fluid-containing bag 84. The handle 86 is then cemented to the outer end of the barrel 70 and into the bore of the barrel as shown. As with the embodiment described in connection with FIGS. 5 and 6, the modification illustrated in FIG. 7 operates by a combination of rotation and longitudinal movement of the handle 86 and barrel 70 and the embodiment may include the spiral slot and engaging key such as described in connection with FIGS. 2–4 and FIGS. 9–12. The sawtooth cutter of FIG. 8 on the inner end 72 of the barrel will very readily cut a large circular opening in the bag 84 to admit the fluid contents into the bore of the barrel 70. Rotation of the barrel 70 to the point where dispensing holes 80 and 82 are no longer in alignment, will shut off the flow of fluid. It will be noted that the barrel 70 is locked into the bore of the sleeve 74 and cannot be removed.

Figure 9:
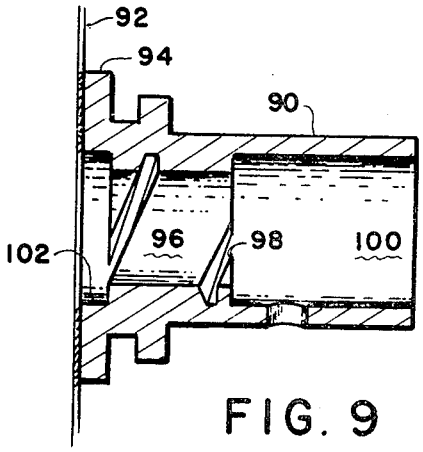
FIG. 9 is a sectional elevation view of a sleeve section with internal threads of a fourth embodiment of the fluid dispenser.
Figure 10:
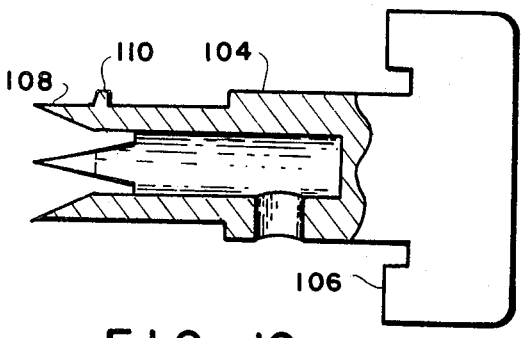
FIG. 10 is a sectional elevation view of a barrel adapted to fit within the sleeve section of FIG. 9.
Figure 11:
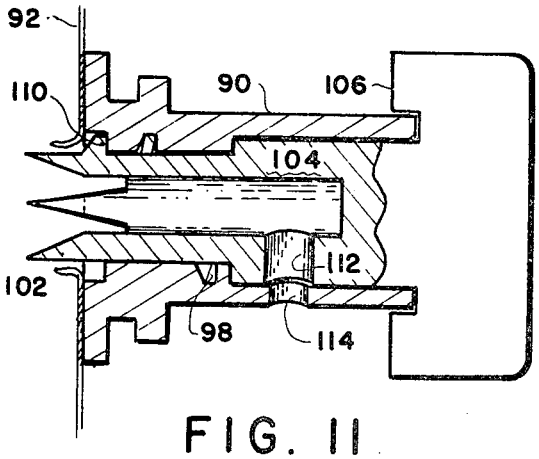
FIG. 11 is a sectional elevation view of the sleeve and barrel of FIGS. 9 and 10 after the cutting of the plastic bag diaphragm.

FIGS. 9, 10 and 11 illustrate still another embodiment of the dispenser using the same bag-opening features of a combination of longitudinal and rotational movement of the barrel.

FIG. 9 is a cross-sectional elevation view of only the sleeve 90 attached to the surface of the plastic bag 92 at the surface of the inner flange 94. The bore of sleeve 90 contains a short section 96 of a smaller diameter in which is formed an approximate one-turn thread 98 which begins in the outer section of the bore 100 and terminates in an annular ring 102 having a diameter approximately the same as that of the bore 100.

FIG. 10 is a sectional view of the barrel 104 that is inserted into the sleeve 90 of FIG. 9. Barrel 104 is tubular in shape with the handle 106 at its outer end and with a plurality of sharpened longitudinal teeth 108 at the opposite or inner end. A key radially extending outward from the outer surface of the barrel 104 and near the toothed inner end thereof, is adapted to engage the thread 98 of FIG. 9.

FIG. 11 is a sectional view of the barrel 104 of FIG. 10 inserted through the bore of sleeve 90 of FIG. 9. When the barrel 104 is first inserted into the sleeve, the wall between the reduced diameter section 96 and the outer bore 100 of the sleeve (FIG. 9) prevents the key 110 on the barrel from being further inserted into the sleeve. As the handle 106 is rotated clockwise, key 110 engages the threads 98 and after the key 110 passes approximately one-half through the threaded reduced area 96, the sharpened points 108 will tear the surface of the bag 92. Further threading of the key 110 through the thread 98, will place the key 110 into the annular ring 102 at which point the bag surface is completely torn and the fluid flows into the bore of the barrel 104. When handle 106 is rotated so that the radial dispensing hole 112 in the barrel 104 is aligned with the radial dispensing hole 114 in the sleeve 90, fluid will be dispensed from the dispenser. The rotation of the handle 106 in either direction will shut off the flow of fluid but the key 110, being rotated through the upper semicircular half of the annular ring 102, will prevent the barrel 104 from being accidentally removed from the sleeve 90. If it is desired to remove the barrel from the sleeve, it is only necessary to rotate the barrel 104 approximately one and one-half turns while gently pulling out the handle 106.

Figure 12:
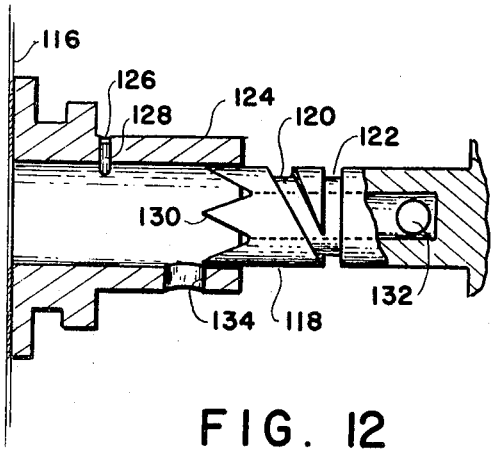
FIG. 12 is a sectional elevation view of still another embodiment with the guide track cut into the outer surface of the barrel.

FIG. 12 is an illustration of a section of still another embodiment of a dispenser which also cuts open a fluid-containing bag 116 upon the combined rotation and longitudinal movement of the dispenser barrel 118. In this embodiment, a screw thread is cut into the outer surface of the tubular barrel 118. The thread 120 begins at one point on the outer surface of the barrel and is spiraled into an annular groove 122. To assemble this dispenser, the barrel 118 is inserted into the sleeve 124. A radial hole 126 through the surface of the barrel 124 is aligned with the thread 120 and a short plastic pin or rod 128 is inserted and cemented into the hole 126 with the inner end of rod 28 engaging the thread 120. The barrel 118 is therefore permanently retained within the sleeve 124 and may only be moved longitudinally when the end of rod 128 is engaged in the thread 120.

In operation, barrel 118 is screwed or rotated clockwise to provide the longitudinal movement required for the sharpened teeth 130 on the inner end of the barrel 118 to cut through the surface of the bag 116. Barrel 118 is further rotated until the inner end of the rod 128 engages the annular groove 122. At that point, further rotation will align the radial dispensing hole 132 in the barrel 118 with the corresponding dispensing hole 134 in the sleeve 124.

It will be noted that all embodiments described herein will cut or shear a fluid-containing bag by a combination of rotation of the dispenser barrel and inward longitudinal movement of the barrel. After the fluid-containing bag has been thus opened, the fluid that flows into the bore of the barrel may be dispensed by only rotational movement of the barrel to the point where there is alignment of radial holes in the barrel and in the outer sleeve.

It will also be noted that in some of the embodiments, to wit, those illustrated in FIGS. 2, 3, 4, 9, 10 and 11, the barrel may be removed from the sleeve prior to the opening of the fluid containing bag. When removed, the barrel may, if desired, be replaced with a tubing connector barrel having the same rotational bag opening characteristics of the removed barrel but with a tubing connector for conveying the fluid contents to some remote fluid tap for dispensing.

I claim:

1. In combination with a bulk fluid container comprising a flexible, sealed, fluid-containing bag, a fluid despenser including:

a tubular sleeve having a first end surface attached to the exterior surface of the fluid-containing bag, the longitudinal axis of said sleeve being substantially perpendicular to said bag exterior surface;

a tubular barrel slidably positioned within the bore of said tubular sleeve, said barrel having a first end adjacent the first end of said sleeve and said sealed bag surface, and a handle at the second end for manual rotation of said barrel within said sleeve;

valving means including a radial dispensing aperture through the wall of said tubular sleeve and through the wall of said tubular barrel and adjacent the second ends of said sleeve and barrel for controlling the flow of fluid from said fluid-containing bag through the bore of said barrel by the rotation of said barrel in said sleeve; and opening means on the first end of said barrel for cutting a substantially circular opening with a diameter at least as large as that of said barrel first end in said sealed fluid-containing bag and within the area of said sleeve end surface by urging means for providing a combined rotational and inward longitudinal movement of said barrel within the bore of said sleeve for shearing said bag surface in a circular pattern between the exterior first end edge of said barrel and the interior first end edge at the bore of said sleeve.

2. The fluid dispenser claimed in claim 1 wherein the first end surface of said barrel has a circular sawtooth exterior edge.

3. The fluid dispenser claimed in claims 1 further including at least one radial fluid admitting aperture in the wall of said barrel adjacent its first end.

4. The fluid dispenser claimed in claim 1 wherein said urging means includes a slot in the exterior wall of said sleeve, said slot starting at the second end of said sleeve and spiraling toward said first sleeve end by a predetermined distance to terminate in an annular slot, said urging means further including a tooth on an overreaching arm on said handle, said tooth engageable with said slot.

5. The fluid dispenser claimed in claim 4 wherein said tubular barrel is removable from said sleeve prior to the opening of said fluid-containing bag.

6. The fluid dispenser claimed in claim 1 wherein said urging means includes a slot in the exterior wall of said barrel, said slot including an annular slot and a spiral slot interconnected with said annular slot and terminating at a point between said annular slot and the first end of said barrel, said urging means further including a pin extending through the wall of said sleeve and engaging said slot for forcing longitudinal movement upon rotation of said barrel when said pin engages said spiral slot, and for preventing removal of said barrel from said sleeve.

7. The fluid dispenser claimed in claim 4 or 6 wherein said opening means includes at least one sharpened tooth longitudinally extending from the exterior edge of the first end of said barrel, the end of said tooth normally withdrawn into said barrel and not in contact with said fluid bag surface, said combined rotational and inward longitudinal urging means causing said tooth end to cut said fluid bag to admit the fluid to enter into the bore of said barrel.

8. The fluid dispenser claimed in claims 1 or 6 wherein said tubular sleeve has first and second spaced annular rings, said first annular ring being flush with the first end of said barrel and providing a flange for attachment of said sleeve to said flexible bag surface, said second annular ring being parallel with and spaced from said first ring by an amount corresponding to the thickness of the wall of a box into which said flexible bag may be placed and which has a wall slot for the fastening of said fluid dispenser exterior of said box.

* * * * *